US005809861A

United States Patent [19]

Hummel

[11] Patent Number: 5,809,861

[45] Date of Patent: Sep. 22, 1998

[54] YARN HAVING A BRAIDED COVERING THEREON AND SAFETY APPAREL KNITTED THEREFROM

[75] Inventor: Joseph Hummel, Amherst, Ohio

[73] Assignee: Whizard Protective Wear Corp., Birmingham, Ohio

[21] Appl. No.: 157,408

[22] Filed: Feb. 18, 1988

Related U.S. Application Data

[63] Continuation-in-part of Ser. No. 79,828, Jul. 30, 1997, abandoned.

[51] Int. Cl.[6] ..... D02G 3/06; D04C 1/00

[52] U.S. Cl. ..... 57/230; 87/6; 87/7; 87/8; 87/9; 87/5

[58] Field of Search ..... 57/230; 87/5–8, 87/9

[56] References Cited

U.S. PATENT DOCUMENTS

| | | | |
|---|---|---|---|
| 3,145,525 | 8/1964 | Laureti | 57/211 |
| 3,155,768 | 11/1964 | Garshick | 174/101.5 |
| 3,265,809 | 8/1966 | Morieras | 174/121 |
| 3,288,175 | 11/1966 | Valko | 57/901 |
| 3,405,516 | 10/1968 | Laureti | 57/210 |
| 3,572,397 | 3/1971 | Austin | 139/426 |
| 3,722,440 | 3/1973 | Igarashi et al. | 112/262 |
| 3,805,667 | 4/1974 | Orser | 87/6 |
| 3,968,725 | 7/1976 | Holzhauer | 87/6 |
| 4,004,295 | 1/1977 | Byrnes | 2/161 |
| 4,074,512 | 2/1978 | Matt | 57/140 |
| 4,186,648 | 2/1980 | Clausen et al. | 89/36 |
| 4,202,382 | 5/1980 | Westhead | 139/383 |
| 4,274,448 | 6/1981 | Westhead | 139/420 |
| 4,350,731 | 9/1982 | Siracusano | 428/234 |
| 4,384,449 | 5/1983 | Byrnes et al. | 57/210 |
| 4,413,110 | 11/1983 | Kavesh et al. | 526/348.1 |
| 4,458,475 | 7/1984 | Schmit et al. | 57/902 |
| 4,470,251 | 9/1984 | Bettcher | 57/230 |
| 4,886,691 | 12/1989 | Wincklhofer | 428/68 |
| 5,070,540 | 12/1991 | Bettcher et al. | 57/210 |
| 5,119,512 | 6/1992 | Dunbar et al. | 2/167 |
| 5,177,948 | 1/1993 | Kolmes et al. | 57/229 |

*Primary Examiner*—William Stryjewski
*Attorney, Agent, or Firm*—Watts Hoffmann Fisher & Heinke

[57] ABSTRACT

A cut-resistant braided yarn and apparel knit from the yarn; the braided yarn may be constructed as a simple hollow braid, but preferably comprises a core and a covering braided on the core; the braid or the braided covering on the core of the yarn comprises three or more strands of fiber selected from high and normal-strength fibers; the core comprises a high-strength fiber core-strand and may include a stainless steel wire core-strand; the denier and number of braiding strands is such that the final diameter of the yarn does not exceed about 0.035" (thirty five thousandths of an inch).

30 Claims, 1 Drawing Sheet

YARN HAVING A BRAIDED COVERING THEREON AND SAFETY APPAREL KNITTED THEREFROM

RELATED APPLICATIONS

This application is a continuation-in-part of U.S. Ser. No. 07/079,828, filed Jul. 30, 1987, for a Cut-Resistant Glove with Improved Dimensional Stability, now abandoned.

TECHNICAL FIELD

This invention relates generally to cut-resistant yarn and apparel and, more particularly, to a yarn of fiber and stainless steel having a braided covering and gloves knit therefrom, the yarn having improved uniformity, surface characteristics, and roundness, so that safety apparel knit from the yarn exhibits improved cut and slash resistance as well as improved abrasion resistance.

BACKGROUND

Protective apparel knit from yarn comprising flexible strands of metal wire and fibers have been proposed.

For example, U.S. Pat. No. 4,004,295 discloses an aramid ("Kevlar") fiber and metallic wire cut resistant glove. U.S. Pat. No. 4,384,449 shows a protective glove made of yarn having a core of stainless steel wires, aramid fiber, such as "Kevlar," and two outer wrappings of aramid fiber. U.S. Pat. No. 4,470,251 shows a safety glove knit from yarn having a core of stainless steel wires and a strand of high strength aramid fiber surrounded by one wrapping of aramid fiber and an overwrap of nylon.

As explained in the respective patents, each construction has its particular advantages. However, some drawbacks exist to most materials, and the various constructions represent a balance of characteristics that are believed best for particular purposes. For example, an all high-strength aramid fiber and wire yarn glove provides a high degree of cut resistance, but the glove is not as comfortable or washable as one knit from yarn having a nylon overwrap. A glove similar in construction to those shown in the '449 and '251 patents but employing nylon for both wrappings is comfortable and is sufficiently cut resistant for use as a liner for an over-glove to provide protection.

These types of gloves with wrapped-on overwraps have the disadvantage that should the glove be cut or slashed deeply enough so that the overwraps are severed down to or through the core, the overwraps tend to unravel and to continue to unravel during use, soon rendering the glove useless for protecting the operator's hand.

These wrapped-on coverings are wound about the core separately and in opposite directions to balance the yarn; the tightness and uniformity of the winding as well as the tension of the turns affects the stability of the overwraps on the core; instability of the overwraps can lead to slippage, which in turn can cause the individual strands of the overwrap to separate in some places and to bunch up in other places, exposing the core and presenting an uneven surface. In the previous wrapped-on construction, a closely and tightly wound helical wrap was employed in an attempt to yield a smooth outer surface and to prevent exposure of the core. This exposure of the core through the wrapped-on coverings is known as "blowout" due to the appearance of the extruded core through the covering. "Blowout" gives rise to an uneven and abrasive surface on the yarn that is disadvantageous to the knitting therefrom of gloves and protective garments. The tightness of the wind imparted a twist to the yarn which meant that a garment had to be knit from two strands of yarn, each having an opposite twist, that is one strand was wound with each of its coverings in a direction opposite that of each of the coverings on the other strand of yarn. In this way, each yarn strand compensated for the natural twist of the other. The counteraction of the two yarn strands resulted in a garment or glove which did not tend to twist as would a glove knit from two yarn strands ostensibly balanced individually but coming from the same spool of yarn.

It has been found that braiding a covering on the core of the yarn obviates problems due to unraveling should the overwraps be cut during use, prevents the problems associated with the uneven tightness and uneven surface of wound-on coverings; knitting from but one strand yields gloves and garments having no tendency to twist, yet exhibiting enhanced cut-resistance as well as other desirable attributes.

SUMMARY OF THE INVENTION

The invention provides a cut-resistant braided yarn and apparel knit from the yarn. The braided yarn may be constructed as a simple hollow braid, but preferably comprises a core and a covering braided on the core; the braided yarn or the braided covering on the core of the yarn comprises three or more strands of fiber selected from high and normal-strength fibers; the core comprises a high-strength fiber core-strand and may include a stainless steel wire core-strand; the denier and number of braiding strands is such that the final diameter of the yarn does not exceed about 0.035" (thirty five thousandths of an inch).

The braided yarn of the present invention is referred to as such whether the yarn comprises a hollow braid or a core having a braided-on covering.

The braided yarn has a smoother surface than prior constructions because a braid does not have the continuous helical wrap which can give rise to separations and the bunching of fibers inherently found in wound-on coverings. The bunching up of fibers especially leads to an uneven surface. The smoother surface of the braided yarn appears to impart an enhanced abrasion resistance to gloves and safety apparel knit from the yarn.

When braiding is employed to make a yarn comprising a core and a braided covering thereon, the process allows the outer covering to slide relative to the core better than wound-on coverings; this enhanced sliding coupled with the absence of separations and bunchings yields a yarn easier to knit. The increased slidability of the braided-on covering means that the core can move more freely relative to the outer covering which results in a more flexible yarn.

The ability of a braided-on covering to cover the core completely and without bunching-up and separating while not having to be wound on tightly also appears to play a role in the enhanced cut resistance of the yarn of the invention. The braided covering, not needing to be so tight as in the helically-wrapped-on construction, allows the finished yarn to have a greater bulk yet be more flexible than a comparable yarn with helically-wrapped-on covering. As a result, the new construction gives a softer surface to gloves and other safety apparel made from the yarn.

As used in the specification and the claims, the term braiding refers to the intertwining of three or more strands to make a cord. The strands form a regular diamond pattern down the length of the cord. Picks per inch refers to the number of cross-overs in an inch of braided cord; the number of diamonds in a linear inch of cord is equal to the number of picks.

The term "high-strength fibers" refers to fibers exhibiting a tenacity greater than about 20 grams per denier (gpd). For example, "Kevlar 29," a high-strength aromatic polyamide, marketed by E. I. duPont de Nemours Co. of Wilmington, Del., exhibits a tenacity of about 22 gpd; "Spectra," a high-strength stretched polyethylene, marketed by Allied Corporation, Fibers Division of Petersburg, Va., 23804, and other high-strength polyolefin fibers such as those disclosed in U.S. Pat. No. 4,413,110, have a tenacity of about 30 gpd according to published data.

The term "normal-strength" fibers refers to fibers exhibiting a tenacity of less than about 20 gpd, and typically, less than about 10 gpd. For example, according to published data, preferred polyolefin, "Marvess," marketed by Phillips Fiber Corporation of Greenville, N.C., 29602, exhibits a tenacity of about 7 gpd, and preferred nylons such as "Nylon 6" and "Nylon 6,6" marketed by Avtex Fibers, Inc., of Valley Forge, Pa., exhibit tenacities of about 2–7 gpd and 2–9 gpd, respectively. A "high-strength" fiber, such as "Kevlar 29," exhibits a tensile strength of about four hundred thousand pounds per square inch (400,000 lbs/sq. in.) whereas a "normal-strength" fiber, such as "Marvess," exhibits a tensile strength of about twenty thousand to fifty thousand pounds per square inch (20,000–50,000 lbs/sq. in), and "Nylon 6" and "Nylon 6,6" exhibit tensile strengths of about forty thousand to about one hundred thousands pounds per square inch (40,000 to 100,000 psi).

Preferably, core-fiber strands and braiding strands are of the multifilament type, regardless of which particular fiber is selected and regardless of whether the fiber is high-or normal-strength.

Accordingly, this invention provides for a cut-resistant braided yarn comprising three to twelve strands of fiber selected from both high- and normal-strength fibers, the high-strength fibers being synthetic fibers, and having a denier of from about one hundred (100D) to about five hundred (500D), and the normal-strength fibers being selected from synthetic or natural fibers and having a denier of from about seventy-five (75D) to about three hundred (300D), the deniers as well as the number of braiding strands being such that the finished diameter of the yarn is less than about thirty-five thousandths of an inch (0.035"). The high-strength fibers may be synthetic fibers such as an aromatic polyamide fiber or a high-strength polyethylene; the normal-strength fibers may be synthetic fibers such as polyolefin or nylon or natural fibers such as cotton or rayon.

This invention further provides for a cut-resistant braided yarn comprising a core and a braided covering on the core, the core comprising a strand of high-strength synthetic fiber having a denier from about eight hundred (800D) to about two thousand (2000D) and being an aromatic polyamide fiber or a high-strength polyethylene, and the braided covering consisting of three to twelve strands of synthetic fiber, one or more of which are of a high-strength synthetic fiber, such as an aromatic polyamide fiber or a high-strength polyethylene, having a denier of from about one hundred (1000D) to about five hundred (500D), and the remainder of which are of normal-strength polyolefin or nylon having a denier of from about seventy-five (75D) to about three hundred (300D), the deniers of the core strand and the braiding strands, as well as the number of braiding strands being such that the finished diameter of the yarn is less than about thirty-five thousandths of an inch (0.035").

This invention still further provides for a cut-resistant braided yarn comprising a core and a braided covering on the core, the core including a strand of flexible fully annealed stainless steel wire of a diameter in the range of from about one thousandths of an inch (0.001") to about ten thousandths of an inch (0.010") and a core strand of high-strength synthetic fiber having a denier from about eight hundred (800D) to about two thousand (2000D) and being an aromatic polyamide fiber or a high-strength polyethylene, and the braided covering consisting of three to twelve strands of synthetic fiber, one or more of which may be of a high-strength synthetic fiber, such as an aromatic polyamide fiber or a high-strength polyethylene, having a denier of from about one hundred (100D) to about five hundred (500D), and the remainder of which are of normal-strength polyolefin or nylon having a denier of from about seventy-five (75D) to about three hundred (300D), the deniers of the core strand and the braiding strands, as well as the number of braiding strands being such that the finished diameter of the yarn is less than about thirty-five thousandths of an inch (0.035").

The invention also provides a cut-resistant machine-knitted article of apparel, and more specifically a flexible glove, at least in part made from any of the above described yarns. A particularly advantageous article is made utilizing yarn comprising a core and a braided covering on the core, the core including a strand of flexible wire of a diameter in the range of from about one thousandths of an inch (0.001") to about ten thousandths of an inch (0.010") and a core strand of high-strength synthetic fiber having a denier from about eight hundred (800D) to about two thousand (2000D) and being an aromatic polyamide fiber or a high-strength polyethylene, and the braided covering consisting of three to twelve strands of synthetic fiber, one or more of which may be of a high-strength synthetic fiber, such as an aromatic polyamide fiber or a high-strength polyethylene, having a denier of from about one hundred (100D) to about five hundred (500D), and the remainder of which are of normal-strength polyolefin or nylon having a denier of from about seventy-five (75D) to about three hundred (300D), the deniers of the core strand and the braiding strands, as well as the number of braiding strands being such that the finished diameter of the yarn is less than about thirty-five thousandths of an inch (0.035").

In the preferred embodiment, the yarn utilizes eight strands of synthetic fiber in the braided covering, with the braided covering having 20 picks per inch.

Further features and advantages of the invention will be hereinafter referred to and will be apparent to those skilled in the art from the following description of the preferred embodiments of the invention and references to alternative constructions.

DESCRIPTION OF THE PREFERRED EMBODIMENTS

Figure 2:
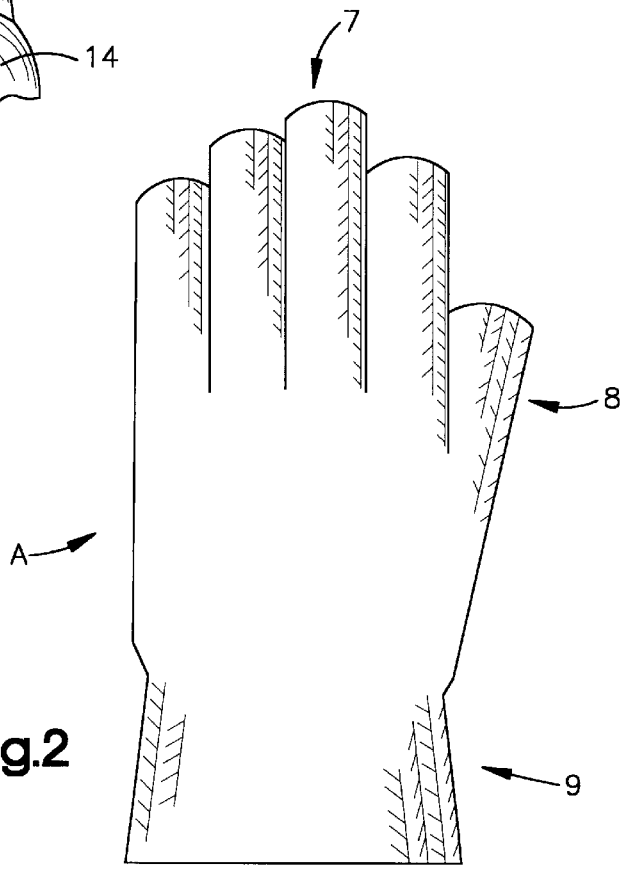
FIG. 2 is a plan view of a safety glove of the present invention knit, at least in part, of yarn such as shown in FIG. 1.

The depicted glove A in FIG. 2 is exemplary of a safety article of apparel embodying the present invention and is a safety or protective glove suitable to be worn by an operator in the food processing and like industries as a protective glove.

The glove A has the usual finger and thumb stalls 7,8 respectively, and a wrist part 9 which may incorporate an elastic thread. The glove is made using conventional methods and glove knitting machinery.

Figure 1:
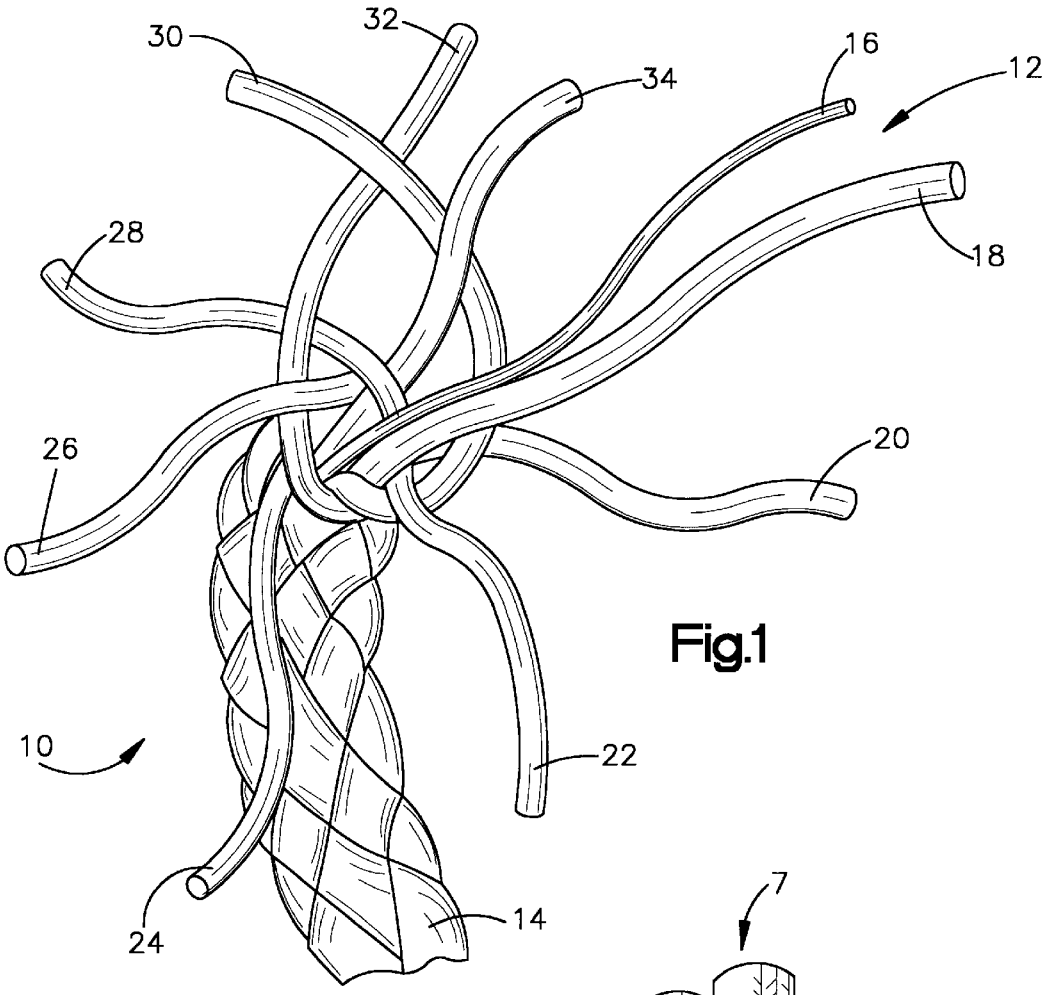
FIG. 1 is a fragmentary, diagrammatic view of a yarn embodying the invention and employed in knitting a safety glove or other apparel of the present invention.

The yarn 10 shown in FIG. 1 is used to knit a safety garment and particularly a glove A primarily for use by a worker in the food processing industry. The yarn 10 comprises a core part 12 and a braided covering 14. The core part 12 comprises a stainless steel wire 16 and an adjacent strand of high-strength synthetic fiber 18. The braided covering 14 consists of eight strands 20, 22, 24, 26, 28, 30, 32, and 34 which are braided so that there are twenty picks per inch. As will be appreciated, the size and number of braiding strands as well as the number of crossovers for those strands affects the final diameter of the yarn. In order to be machine knittable, the final diameter of the yarn should be less than about thirty-five thousandths of an inch (0.035"); in order to impart the desired degree of cut-resistance to the finished garment, considering the nature of the materials employed in the core and in the braiding strands, the final diameter is preferably about twenty-five thousandths to about thirty-five thousandths of an inch (0.025"–0.035"), and most preferably, about thirty thousandths of an inch (0.030").

A finished diameter of about thirty thousandths of an inch (0.030") was achieved with the combinations of core and braiding strand materials, wherein the covering was braided on with twenty (20) picks to the inch, given in the following examples:

TABLE I

| CORE | BRAIDING STRANDS |
|---|---|
| Example 1 | |
| 1 strand<br>0.003" stainless steel<br>1 strand<br>1500 denier Kevlar | 8 strands<br>210 denier<br>polyolefin |
| Example 2 | |
| 1 strand<br>0.003" stainless steel<br>1 strand<br>1500 denier Kevlar | 4 strands<br>210 denier<br>polyolefin<br>4 strands<br>200 denier<br>Kevlar |
| Example 3 | |
| 1 strand<br>0.003" stainless steel<br>1 strand<br>1500 denier Kevlar | 4 strands<br>210 denier nylon<br>4 strands<br>200 denier<br>Kevlar |
| Example 4 | |
| 1 strand<br>0.003" stainless steel<br>1 strand<br>1200 denier Spectra 900 | 4 strands<br>375 denier<br>Spectra 1000<br>4 strands<br>125 denier nylon |
| Example 5 | |
| 1 strand<br>0.003" stainless steel<br>1 strand<br>1200 denier Spectra 900 | 4 strands<br>375 denier<br>Spectra 1000<br>4 strands<br>210 denier nylon |
| Example 6 | |
| 1 strand<br>0.003" stainless steel<br>1 strand<br>1200 denier Spectra 900 | 8 strands<br>375 denier<br>Spectra 1000 |
| Example 7 | |
| 1 strand<br>1200 denier Spectra 900 | 8 strands<br>375 denier<br>Spectra 1000 |

In each example, the core 12 is designed to impart cut-resistance, knittability, flexibility, and long life to the yarn 10, while the braided covering 14 is designed to retain the core 12 and to give body to the yarn 10.

The stainless steel wire 16 in the core 12 of Examples 1–6 has a diameter of about three thousandths of an inch (0.003"); stainless steel wire of this size, of 304 stainless steel, fully annealed and having a tensile strength of about 125,000 pounds per square inch, is believed to have the desired properties for imparting optimum flexibility and long life to the yarn 10. The adjacent strand of high-strength synthetic fiber 18 in the core 12 of Examples 1–6 has a tensile strength greater than that of the stainless steel wire 16.

The enhanced attributes of various of the braided yarns in Table I were compared to helically over-wrapped yarns constructed to resemble the composition of the comparable braided yarn as closely as possible. It is to be noted that in each comparison below, the braided yarn sample contained twice the amount of fiber in its braided-on covering as the helically wrapped yarn sample contained in its wrapped-on covering. That is, in all comparisons, the braided cover is composed of a total of eight strands, sometimes all of the same material, sometimes four strands of high-strength fiber and four strands of normal-strength fiber, while the wrapped yarn sample had a wrapped-on covering made of a first wrap of two strands in one direction and a second wrap of two strands in another direction; with either the inner wrap or both wraps being of a high-strength fiber. One reason for this difference between samples in a comparison is that a wrapped yarn having two wrapped-on coverings of four strands each, or four wrapped-on covers of two strands each is not knittable in that the diameter of the resultant yarn far exceeds thirty-five thousandths of an inch (0.035"). See Table II below for a comparison of the weights of gloves knit from braided yarn to weights of gloves knit from the comparable helically-over-wrapped yarn.

In each comparison, the breaking strength and the elongation, as well as the outside diameter were measured on single strands (ends) of the respective yarns, and the average of six to ten samplings is reported.

The slash resistance and abrasion resistance were measured on gloves knit on a knitting machine of the size specified in each comparison, and again, the average reported is that for six to ten samplings.

"Break Lbs" means breaking strength, which is tensile strength measure in pounds; it is the maximum resultant internal force that resists rupture in a tension test of a single strand. Breaking strength and elongation were measured in the same test by attaching one end of a strand to a stationary clamp, and the other end to a movable pulling clamp coupled to an indicator which indicates pulling force and elongation to the break point.

Slash resistance was assessed by pressing a stationary circular knife blade against a single knit layer simulating a glove surface. The knit layer was supported by a hollow cylindrical pressure sensitive support coupled to an indicator similar to that used for breaking strength assessment.

Abrasion resistance was measured in a Taber Abrader set at 1000 cycles. The value reported is the average difference in the weight of a glove before and after abrading.

Comparison 1

A braided yarn as in Example 2 of Table I, above was compared to its comparable over-wrapped yarn as follows:

| Braid | Wrapped | |
|---|---|---|
| 1500$^D$ Kevlar ) | 1500$^D$ Kevlar ) | |
| 1–.003 Stainless ) core | 1–.003 Stainless ) core | |
| 200$^D$ Kevlar-4 carriers | 2/200$^D$ Kevlar-1st. wrap | |
| 200$^D$ Polyolefin-4 carriers | 2/210$^D$ Polyolefin-2nd. wrap | |
| | Braid | Wrap |
| Test Results: | | |
| Single End | | |
| Break Lbs. | 86.3 | 70.2 |
| Elongation % | 4.5 | 3.5 |
| Slash | | |
| $\bar{X}$ Lbs. Break | 26.3 | 15.9 |
| Abrasion | | |
| $\bar{X}$ wt. lbs. (1000 cycles) | .29% | 2.2% |
| Outside Diameter | .029 | .028 |
| Summary of Test Results: | | |
| Single End: | | |
| Break-Braid is 18.7% stronger | | |
| Elongation-Braid is 22.2% higher | | |
| Glove: | | |
| Slash-Braid is 39.5% more cut resistant | | |
| Abrasion-Braid is 86.8% more abrasion resistant | | |

Sample gloves were knitted one end in in a 7 cut, 48 needle machine.

The greater elongation of the braided yarn can be attributed to the greater slippability of the cover over the core compared to the helically wrapped cover.

The braided yarn and glove knit therefrom exceeded the performance of the wrapped yarn and glove knit therefrom in all respects.

In evaluating the abrasion results in this comparison as well as in comparison 2, below, it is to be noted that the exposed surfaces of the braided samples are 50/50 high-strength/low-strength fiber, while the exposed surfaces, of the helically wrapped samples is 100% low-strength fiber. As demonstrated below in comparisons 3 and 4 where the external exposures for both the braided and the wrapped is 100% high-strength synthetic fiber, it appears that the decrease in the amount of material abraded from the braided samples is due not to the nature of the material, but to the braiding process itself.

Comparison 2

A braided yarn as in Example 3 of Table I, above, was compared to its comparable over-wrapped yarn as follows:

| Braid | Wrapped | |
|---|---|---|
| 1500$^D$ Kevlar ) | 1500$^D$ Kevlar ) | |
| 1–.003 Stainless ) core | 1–.003 Stainless ) core | |
| 200$^D$ Kevlar-4 carriers | 2/200$^D$ Kevlar-1st. wrap | |
| 200$^D$ Nylon-4 carriers | 2/210$^D$ Nylon-2nd. wrap | |
| | Braid | Wrap |
| Test Results: | | |
| Single End | | |
| Break Lbs. | 91.9 | 65.3 |
| Elongation % | 4.5 | 4 |
| Slash | | |
| $\bar{X}$ Lbs. Break | 20.4 | 14.1 |
| Abrasion | | |
| $\bar{X}$ wt. lbs. (1000 cycles) | .98% | 1.7% |
| Outside Diameter | .031 | .029 |
| Summary of Test Results: | | |
| Single End: | | |
| Break-Braid is 28.9% stronger | | |
| Elongation-Braid is 11.1% higher | | |
| Glove: | | |
| Slash-Braid is 30.8% more cut resistant | | |
| Abrasion-Braid is 42.4% more abrasion resistant | | |

Sample gloves were knitted one end in in a 7 cut, 48 needle machine.

The braided yarn and glove knit therefrom exceeded the performance of the wrapped yarn and glove knit therefrom in all respects.

Comparison 3

A braided yarn as in Example 6 of Table I, above, was compared to its comparable helically over-wrapped yarn as follows:

| Braid | Wrapped | |
|---|---|---|
| 1200$^D$ Spectra ) | 1200$^D$ Spectra ) | |
| 1–.003 Stainless ) core | 1–.003 Stainless ) core | |
| 375$^D$ Spectra-8 carriers | 375$^D$ Spectra 1000-1st. wrap | |
| | 375$^D$ Spectra 1000-2nd. wrap | |
| | Braid | Wrap |
| Test Results: | | |
| Single End | | |
| Break Lbs. | 71.1 | 51.6 |
| Elongation % | 5.5 | 3 |
| Slash | | |
| $\bar{X}$ Lbs. Break | 35.2 | 17.1 |
| Abrasion | | |
| $\bar{X}$ wt. lbs. (1000 cycles) | .06% | 1.0% |
| Outside Diameter | .031 | .027 |
| Summary of Test Results: | | |
| Single End: | | |
| Break-Braid is 27.4% stronger | | |
| Elongation-Braid is 45% higher | | |

-continued

| Glove: |
|---|
| Slash-Braid is 51% more cut resistant |
| Abrasion-Braid is 94% more abrasion resistant |

Sample gloves were knitted one end in in a 5.5 cut, 38 needle machine.

The braided yarn and glove knit therefrom exceeded the performance of the wrapped yarn and glove knit therefrom in all respects.

Comparison 4

A braided yarn as in Example 7 of Table I, above was compared to its comparable over-wrapped yarn as follows:

| Braid | Wrapped |
|---|---|
| $1200^D$ Spectra 900-core<br>$375^D$ Spectra 1000-8 carriers | $1200^D$ Spectra 900-core<br>$375^D$ Spectra 1000-1st. wrap<br>$375^D$ Spectra 100-2nd. wrap |

| | Braid | Wrap |
|---|---|---|
| Test Results: | | |
| Single End | | |
| Break Lbs. | 72.5 | 48.5 |
| Elongation % | 5.5 | 3 |
| Slash | | |
| $\bar{X}$ Lbs. Break | 33.2 | 14.0 |
| Abrasion | | |
| $\bar{X}$ wt. loss (1000 cycles) | .06 | .6% |
| Outside Diameter | .031 | .027 |
| Summary of Test Results: | | |
| Single End: | | |
| Break-Braid is 33% stronger | | |
| Elongation-Braid is 45% higher | | |
| Glove: | | |
| Slash-Braid is 57.8% more cut resistant | | |
| Abrasion-Braid is 90% more abrasion resistant | | |

Sample gloves were knitted one end in in a 5.5 cut, 38 needle machine.

The braided yarn and glove knit therefrom exceeded the performance of the wrapped yarn and glove knit therefrom in all respects. In this comparison and in comparison 3, above, the composition of the outside of the yarn exposed for abrasion appraisal is the same in both samples—Spectra 1000, yet in both comparisons, the braided samples show a decrease in the amount of weight lost after 1000 cycles of abrasion.

The core in each sample was composed of high-strength Spectra 900 without an adjacent strand of stainless steel wire.

Comparison 5

A braided yarn as in Example 4 of Table I, above, was compared to its comparable over-wrapped yarn as follows:

| Braid | Wrapped |
|---|---|
| $1200^D$ Spectra 900 )<br>1–.003 Stainless ) core<br>$375^D$ Spectra 1000-4 carriers | $1200^D$ Spectra 900 )<br>1–.003 Stainless ) core<br>$375^D$ Spectra 1000-1st. wrap<br>$2/210^D$ Nylon-2nd. wrap |

| | Braid | Wrap |
|---|---|---|
| Test Results: | | |
| Single End | | |
| Break Lbs. | 76.4 | 54.9 |
| Elongation % | 5 | 3.25 |
| Slash | | |
| h$\bar{X}$ Lbs. Break | 25.6 | 15.5 |
| Abrasion | | |
| $\bar{X}$ wt. loss (1000 cycles) | .0% | 1.4% |
| Outside Diameter | .031 | .027 |
| Summary: | | |
| Single End Break-Braid is 28% stronger | | |
| Elongation-Braid is 35% higher | | |
| Glove: | | |
| Slash-Braid is 39% more cut resistant | | |
| Abrasion-Braid is 100% more abrasion resistant | | |

Sample gloves were knitted one end in a 5.5 cut, 38 needle machine.

The braided yarn and glove knit therefrom exceeded the performance of the wrapped yarn and glove knit therefrom in all respects.

| Braid | Wrapped |
|---|---|
| $1500^D$ Kevlar )<br>1–.003 Stainless ) core<br>$200^D$ Polyolefin-8 carrier | $1500^D$ Kevlar )<br>1–.003 Stainless ) core<br>$2/200^D$ Kevlar-1st wrap<br>$2/200^D$ Polyolefin-2nd. wrap |

| | Braid | Wrap |
|---|---|---|
| Test Results: | | |
| Single End | | |
| Break Lbs. | 75.1 | 70.2 |
| Elongation % | 4.0 | 3.5 |
| Slash | | |
| $\bar{X}$ Lbs. Break | 25.7 | 15.9 |
| Abrasion | | |
| $\bar{X}$ wt. lbs. (1000 cycles) | .90% | 2.2% |
| Outside Diameter | .028 | .028 |
| Summary of Test Results: | | |
| Single End: | | |
| Break-Braid is 7% stronger | | |
| Elongation-Braid is 14.3% higher | | |
| Glove: | | |
| Slash-Braid is 61.6% more cut resistant | | |
| Abrasion-Braid is 86.8% more abrasion resistant | | |

Sample gloves were knitted one end in in a 7 cut:, 48 needle machine.

The braided yarn and glove knit therefrom exceeded the performance of the wrapped yarn and glove knit therefrom in all respects.

As seen in comparisons 1–6, the diameter of the yarns is essentially equal even though the braided yarn contains more fiber in the covering than does the wrapped yarn.

Weighing the gloves fabricated with the yarns of comparisons 1–6, above, demonstrates that glove knitted from braided yarn can weigh twice as more as a glove knitted from the comparable wrapped yarn. These results are shown in Table II.

TABLE II

WEIGHTS
MEDIUM SIZE GLOVES, BRAIDED VS. WRAPPED

| COMPARISON | BRAID | WRAPPED |
|---|---|---|
| 1 | 57.0 grams | 50.9 grams |
| 2 | 56.0 grams | 49.1 grams |
| 3 | 68.2 grams | 37.4 grams |
| 4 | 63.3 grams | 34.3 grams |
| 5 | 57.5 grams | 40.0 grams |
| 6 | 57.1 grams | 50.9 grams |

While not wishing to be bound by any theory, the enhanced properties exhibited by gloves fabricated from braided yarn seem in part due to the discovery that a great deal more fiber can be incorporated into a yarn which can knitted by machine into a safety garment when the yarn employs a braided-on covering rather than wrapped-on covering.

While a preferred embodiment of the invention has been described in detail, it will be understood that various modifications and alterations may be made therein without departing from the spirit and scope of the invention set forth in the appended claims.

I claim:

1. A cut-resistant yarn comprising three to twelve strands of fiber selected from high- and normal-strength fibers braided into a yarn, the high-strength fibers having a denier of from about one hundred (100 D) to about five hundred (500 D), and the normal-strength fibers being selected from synthetic or natural fibers and having a denier of from about seventy-five (75 D) to about three hundred (300 D), said braided strands including at least one high-strength strand, the deniers as well as the number of braiding strands being such that the finished diameter of the yarn is less than about thirty-five thousandths of an inch (0.035").

2. The yarn of claim 1 wherein the high-strength fibers are aromatic polyamide fibers or high-strength polyethylene fibers or both.

3. The yarn of claim 1 including a core around which the three to twelve strands of fiber are braided.

4. A yarn suitable for knitting into cut-resistant safety garments and comprising:

a core including a core-strand of high-strength synthetic fiber having a denier from about eight hundred (800D) to about two thousand (2000D); and a braided covering on the core, said braided covering consisting essentially of three to twelve braiding-strands selected from high-strength and normal-strength fibers, the high-strength fibers having a denier of from about one hundred (100D) to about five hundred (500D), and the normal-strength fibers having a denier of from about seventy-five (75D) to about three hundred (300D), the deniers of said core and said braiding-strands, and the number of said braiding-strands, being selected so that the finished diameter of the yarn is less than about thirty-five thousandths of an inch (0.035").

5. The yarn of claim 4 wherein said core-strand of high-strength fiber is selected from the group consisting of aromatic polyamide and high-strength polyethylene fibers.

6. The yarn of claim 4 wherein said core-strand of high-strength fiber is an aromatic polyamide fiber having a denier of about twelve hundred (1200D) to about eighteen hundred (1800D).

7. The yarn of claim 4 wherein said core-strand of high-strength fiber is a high-strength polyethylene having a denier of about seven hundred (700D) to about eleven hundred (100D).

8. The yarn of claim 4 wherein said core-strand of high-strength fiber is an aromatic polyamide fiber having a denier of about fifteen hundred (1500D), and said braiding strands comprise eight strands of 200 denier high-strength polyamide.

9. The yarn of claim 4 wherein said core-strand of high-strength fiber is a high-strength polyethylene having a denier of about nine hundred (900D) to about twelve hundred (1200D), and said braiding strands comprise eight strands of high-strength polyethylene having a denier of about two hundred (200D) to about four hundred (400D).

10. The yarn of claim 4 wherein said high-strength braiding-strands are selected from high-strength aromatic polyamide fiber or high-strength polyethylene fiber, or both.

11. A cut-resistant safety garment knit at least in part from yarn comprising:

a core including a strand of flexible wire of a diameter in the range of from about one thousandths of an inch (0.001") to about ten thousandths of an inch (0.010") and a core-strand of high-strength synthetic fiber having a denier from about eight hundred (800D) to about two thousand (2000D); and a braided covering on the core, said braided covering consisting essentially of three to twelve braiding-strands of synthetic fiber, one or more of said braiding-strands being a high-strength synthetic fiber having a denier of from about one hundred (100D) to about five hundred (500D), and the remainder of said braiding-strands being of normal-strength fiber having a denier of from about seventy-five (75D) to about three hundred (300D), the deniers of said core strand and said braiding-strands and the number of said braiding-strands being selected so that the finished diameter of the yarn is less than about thirty-five thousandths of an inch (0.035").

12. The garment of claim 11 where the core-strand of flexible wire comprises a stainless steel wire having a diameter of about three thousandths of an inch (0.003"), the core-strand of high-strength synthetic fiber comprises 1500 denier high strength polyamide, and the braiding strands comprise eight strands of 210 denier polyolefin.

13. The garment of claim 11 where the core-strand of flexible wire comprises a stainless steel wire having a diameter of about three thousandths of an inch (0.003"), the core-strand of high-strength synthetic fiber comprises 1500 denier high-strength polyamide, and the braiding strands comprise four strands of 210 denier polyolefin and four strands of 200 denier high-strength polyamide.

14. The garment of claim 11 where the core-strand of flexible wire comprises a stainless steel wire having a diameter of about three thousandths of an inch (0.003"), the core-strand of high-strength synthetic fiber comprises 1500 denier high-strength polyamide, and the braiding strands comprise four strands of 210 denier nylon and 4 strands of 200 denier high-strength polyamide.

15. The garment of claim 11 where the core-strand of flexible wire comprises a stainless steel wire having a diameter of about three thousandths of an inch (0.003"), the core-strand of high-strength synthetic fiber comprises 1200 denier high-strength polyethylene and the braiding strands comprise four strands of 375 denier high-strength polyethylene and four strands of 210 denier nylon.

16. The garment of claim 11 where the core-strand of flexible wire comprises a stainless steel wire having a diameter of about three thousandths of an inch (0.003"), the core-strand of high-strength synthetic fiber comprises 1200 denier high-strength polyethylene and the braiding strands comprise four strands of 375 denier high-strength polyethylene and four strands of 125 denier nylon.

17. The garment of claim 11 where the core-strand of flexible wire comprises a stainless steel wire having a diameter of about three thousandths of an inch (0.003"), the core-strand of high-strength synthetic fiber comprises 1200 denier high-strength polyethylene and the braiding strands comprise eight strands of 375 denier high-strength polyethylene.

18. The garment of claim 11 where the core-strand of flexible wire comprises a stainless steel wire having a diameter of about three thousandths of an inch (0.003"), the core-strand of high-strength synthetic fiber comprises 1200 denier high-strength polyethylene and the braiding strands comprise four strands of 375 denier high-strength polyethylene and four strands of 210 denier nylon.

19. The subject matter of claims 11, 12, 13, 14, 15, 16, 17, or 18 wherein the garment is a glove.

20. A cut-resistant machine-knittable yarn comprised of at least three outer braided strands of fiber, at least one of the braided strands comprised of synthetic fiber having a tenacity of greater than about 20 grams per denier, the diameter of the yarn being no greater than about thirty-five thousandths of an inch (0.035 inch).

21. A cut-resistant machine-knittable yarn comprised of a core and a braided cover, the core comprised of a fiber strand and the cover comprised of at least three fiber strands, and wherein at least one of the cover fiber strands has a tenacity greater than about 20 grams per denier.

22. A yarn suitable for machine-knitting into a cut-resistant safety garment and comprising:

a core including one or more strands comprised of fiber or wire or both, a braided covering comprised of three to twelve fiber strands, at least one of said fiber strands in the covering being comprised of a high-strength synthetic fiber, and said yarn having a diameter no greater than about thirty-five thousandths of an inch (0.035").

23. A cut-resistant yarn comprising a core comprised of high-strength fiber having a denier from about eight hundred (800D) to about two thousand (2000D) around which three to twelve strands of fiber are braided into a yarn, said braided strands selected from high- and normal-strength fibers, the high-strength fibers having a denier of from about one hundred (100D) to about five hundred (500D), and the normal-strength fibers being selected from synthetic or natural fibers and having a denier of from about seventy-five (75D) to about three hundred (300), the deniers as well as the number of braiding strands being such that the finished diameter of the yarn is less than about thirty-five thousandths of an inch (0.035").

24. A cut-resistant yarn comprising a core comprised of high-strength fiber having a denier from about eight hundred (800D) to about two thousand (2000D) and a strand of flexible wire of a diameter in the range of from about one thousandth of an inch (0.001") to about ten thousandths of an inch (0.010"), around which three to twelve strands of fiber are braided into a yarn, said braided strands selected from high- and normal-strength fibers, the high-strength fibers having a denier of from about one hundred (100D) to about five hundred (500D), and the normal-strength fibers being selected from synthetic or natural fibers and having a denier of from about seventy-five (75D) to about three hundred (300D), the deniers as well as the number of braiding strands being such that the finished diameter of the yarn is less than about thirty-five thousandths of an inch (0.035").

25. A protective glove knitted of a cut-resistant machine knittable yarn comprised of at least three outer braided strands of fiber, at least one of the braided strands comprised of synthetic fiber having a tenacity of greater than about 20 grams per denier, the diameter of the yarn being no greater than about thirty-five thousandths of an inch (0.035").

26. A protective glove knitted of a cut-resistant machine knittable yarn comprised of a core and a braided cover, the core comprised of a fiber strand and the cover comprised of at least three fiber strands, and wherein at least one of the fiber strands has a tenacity greater than about 20 grams per denier.

27. A cut-resistant yarn consisting essentially of only three to twelve braided strands selected from high-strength cut-resistant fibers and normal strength fibers forming a braided coreless yarn, the high-strength fibers having a denier of from about one hundred (100D) to about five hundred (500D), and the normal-strength fibers being selected from synthetic or natural fibers and having a denier of from about seventy-five (75D) to about three hundred (300), said braided strands including at least one high-strength strand, the deniers as well as the number of braiding strands being such that the finished diameter of the yarn is less than about thirty-five thousandths of an inch (0.035").

28. A yarn as set forth in claim 1, 2, 3, 4, 5, 6, 7, 8, 9, 10, 23, 24 or 27 knit in the form of a protective cut-resistant glove.

29. A protective glove knitted of cut-resistant machine knittable yarn comprised of at least three braided strands of fiber, at least one of the braided strands comprised of a high-strength cut-resistant synthetic fiber, the diameter of the yarn being no greater than about thirty-five thousandths of an inch (0.035").

30. In a method of making a machine-knittable cut-resistant of braided yarn, the steps comprising, forming a yarn by providing a core having one or more strands of wire or fiber or both, forming a cut-resistant covering about the core by braiding about the core three to twelve fiber strands at least one of which is comprised of a high-strength synthetic fiber, and selecting the strands so that the diameter of the yarn is less than about thirty-five thousandths of an inch (0.035").

* * * * *